US005617908A

United States Patent [19]

Toogood

[11] Patent Number: 5,617,908

[45] Date of Patent: Apr. 8, 1997

[54] CHIPPING CUTTER HEAD INCLUDING END CUTTING KNIVES

[75] Inventor: William C. Toogood, Beaverton, Oreg.

[73] Assignee: Key Knife, Inc., Portland, Oreg.

[21] Appl. No.: 487,191

[22] Filed: Jun. 7, 1995

[51] Int. Cl.[6] ..... B27G 13/00; B26D 1/12

[52] U.S. Cl. ..... 144/218; 144/39; 144/231; 144/228; 144/235; 144/373; 407/113

[58] Field of Search ..... 144/3.1, 39, 41, 144/114.1, 118, 162.1, 176, 218, 220, 229, 223, 224, 231, 228, 235, 241, 369, 373, 374, 375, 236, 237, 43; 407/113, 114

[56] References Cited

U.S. PATENT DOCUMENTS

| | | | |
|---|---|---|---|
| 479,332 | 7/1892 | Patten | 144/38 |
| 1,284,092 | 11/1918 | Gray | 144/38 |
| 1,315,734 | 9/1919 | Mattison | 144/235 |
| 1,355,024 | 10/1920 | Allen | 144/235 |
| 1,472,960 | 11/1923 | Conklin | 144/235 |
| 4,269,244 | 5/1981 | Kinsella | 144/231 |
| 5,333,659 | 8/1994 | Carpenter et al. | 144/231 |
| 5,348,065 | 9/1994 | Meyer | 144/231 |

*Primary Examiner*—W. Donald Bray
*Attorney, Agent, or Firm*—Kolisch, Hartwell, Dickinson, McCormack & Heuser

[57] ABSTRACT

A substantially cylindrical cutter head for cutting chips from wood. The cutter head has a body formed of disc-shaped body sections mounted in a substantially axially aligned position. Double-edged knives are mounted on the perimeter of the cutter head body, and also on the end of the cutter head body.

4 Claims, 3 Drawing Sheets

CHIPPING CUTTER HEAD INCLUDING END CUTTING KNIVES

BACKGROUND AND SUMMARY OF THE INVENTION

This invention relates generally to what is referred to herein as a chipping cutter head usable in removing chips from an elongate region extending along the side of a work piece such as a log, to produce a flat surface along the side of the log bounding the region where wood has been removed in the form of chips. In processing a log, it is common to produce to cut away the convexly curved outer surface regions of a log on opposite sides, to form opposite flat sides in the remainder of the log and chips in the material that is removed.

One type of chipping cutter head which has been proposed in the past is the log slabbing cutter head disclosed in prior issued U.S. Pat. No. 5,271,442. In this cutter head, elongate knives distributed about the cutter head, and extending at an angle so that their cutting edges diverge from the axis of the cutter head progressing outwardly on the cutter head, function to produce cut chips as the cutter head is rotated under power. The cutting edges of these knives converge on each other progressing toward inner ends of the knives, and a flat surface in the log is produced by additional knives, sometimes referred to as planar cutting knives, which move in a common plane extending normal to the axis of the cutter head.

The cutter head of the log slabbing chipper just described, with cutting knives movable in a conical path, has achieved wide commercial acceptance. The cutter heads have been used to produce chips of good quality, with a flat, substantially finished surface bounding the side of the log where wood material has been removed in chip form.

In certain structures, however, the cutter heads offer problems. Further explaining, because of the inclined position of the knives producing the conical cutting action, a cutting head in the region of the outer flared ends of the knives tends to have an excessively large diameter. This tends to introduce cost to the cutter head. Further, the large diameter tends to impart a limit to the rotation speed of the cutter head. With knives extending at an angle, there is a limit to the depth of cut obtainable in a log if a cutter head without a large outer diameter is to be employed. With the depth of cut limited, a problem obviously arises in the handling of tapered or crooked logs.

A general object of this invention is to provide a new and improved chipping cutting head, where the cutter head has a generally cylindrical overall configuration as compared to the general conical configuration in the cutter heads of prior art. Chips are cut from the side of the log which is removed with the cutting edges of knives which extend generally in an axial direction, and without substantial divergence from the axis of the cutter head. A smooth cut surface is produced in the side of the log bounding where the chips have been removed by knife edges that move in a common planar cutting path disposed normal to the rotation axis of the cutting head.

Another object is to provide a chipping cutter head, where the cutting head has a generally cylindrical configuration, and the end of the cutter head as well as the cylindrical outer perimeter of the cutter head are conjointly used for the mounting of knives producing chip removal and a finished cut surface in a log.

A more specific object is to provide a cutter head of generally cylindrical overall configuration, where multiple double-edged removable and replaceable knives are incorporated to provide the cutting edges producing the chips and the flat surface which bounds the log after chip removal. A double-edged knife when mounted on the cutter head has one cutting edge in an exposed operative cutting position, and an opposite cutting edge in an inoperative non-cutting position which is shielded and not exposed. After a period of use, new cutting edges may be provided merely by removing the knives and then replacing them with the knives turned on themselves, so that edges heretofore held in a shielded inoperative position now have an exposed operative cutting position.

Yet a further object of the invention is to provide a chipping cutter head with multiple knives at the end of the cutting head and extending along the cylindrical perimeter thereof, where the body of the cutter head is formed of multiple, disc-shaped body sections, disposed end-to-end. A body section forming one end of the cutter head body mounts one group of knives movable in a circumferential cutting path for removing chips, and another group of knives movable in a planar cutting path for producing a smooth cut surface in the log processed. Body sections disposed away from this end normally need mount only circumferentially located knives usable in the production of chips.

BRIEF DESCRIPTION OF THE DRAWINGS

These and other objects and advantages are attained by the invention, which is described herein below in conjunction with the accompanying drawings, wherein.

DETAILED DESCRIPTION OF THE PREFERRED EMBODIMENT

Figure 1:
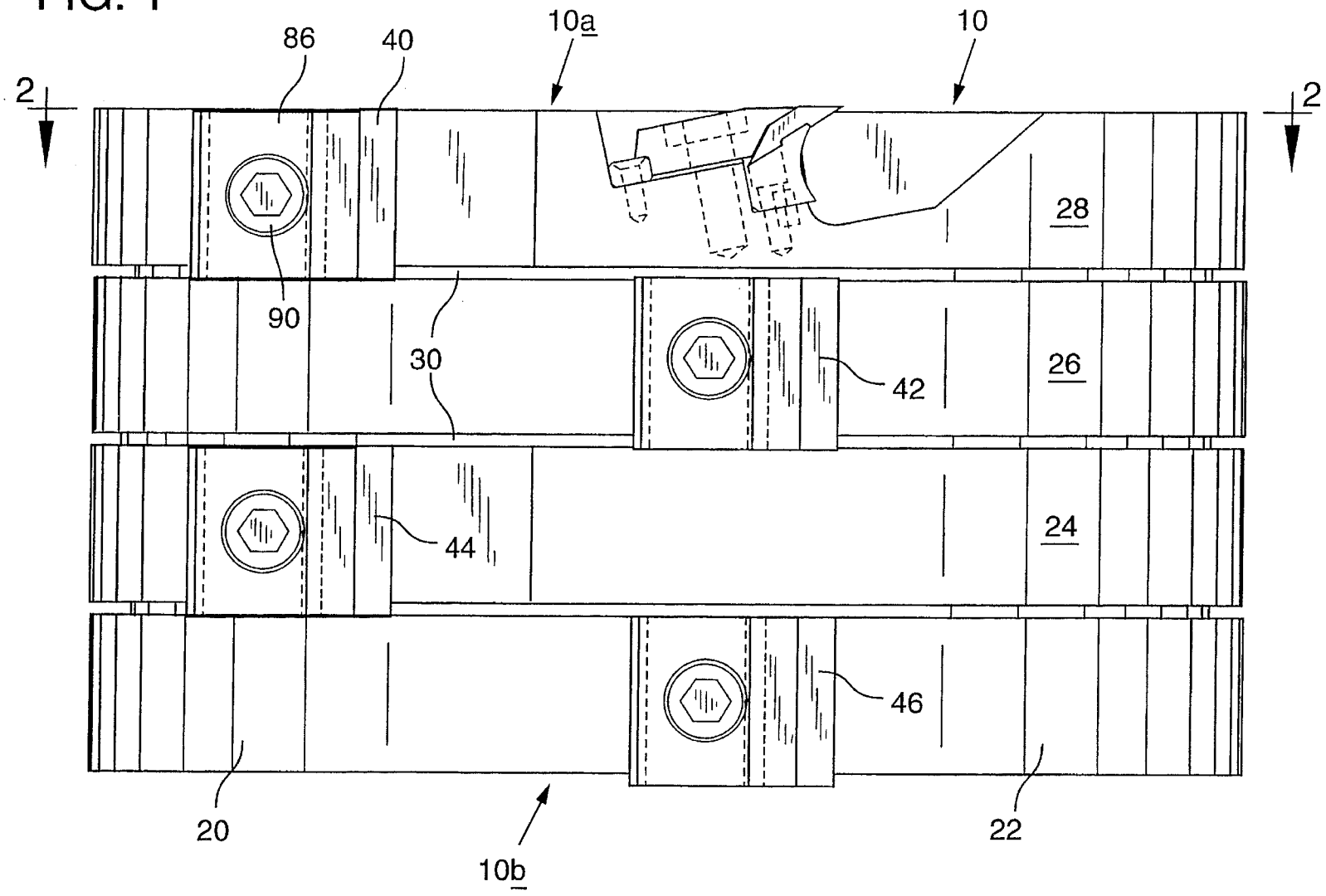
FIG. 1 is a view showing a side of a cutter head constructed pursuant to the invention.

Referring now to the drawings, a chipping cutter head as contemplated by the invention is indicated generally at 10. The cutter head has a generally cylindrical overall configuration, and opposite ends delineated by end faces occupying planes which are normal to the axis of the cutter head, indicated at 10*a* and 10*b*. When installed on chipping apparatus, the cutter head is mounted on a suitable power rotated shaft 12 (see FIG. 2), with the cutter head keyed to the shaft so as to rotate with the shaft.

In a conventional installation, the cutter head, and powered shaft mounting it, are supported on a suitable stand, and suitable structure provided for supporting a log with the stand and support structure being relatively movable whereby relative lengthwise movement of the log is produced across the end of the cutting head. Additionally, of course, the stand ordinarily is adjustable in a direction extending transversely of this log, to adjust the depth of cut produced by the chipping cutter head during a cutting pass. In the drawings (FIG. 2), a portion of a typical log is shown by the dashed outline 14.

Considering more in detail specifics of the chipping cutter head herein disclosed, the cutter head includes a cutter head body 20 of substantially cylindrical overhaul configuration. In the particular embodiment pictured, the body comprises multiple disc-shaped segments (four are illustrated in FIG. 1, given the reference numbers 22, 24, 26 and 28), disposed end to end and in axial alignment on shaft 12. The segments may be spaced a slight distance from these other as with spacers 30. The segments are suitably secured to each other, to form a unified structure.

Multiple, circumferentially located, double-edged knives are detachably mounted on cutter head body 20. In the specific cutter head illustrated, these knives include a group of four knives 40 detachably mounted on end disc segment 28, and equally circumferentially distributed thereabout. In the next adjacent disc segment 26, another group of four knives such as knife 42 are detachably mounted in place, with these knives equally circumferentially distributed and staggered with respect to the knives mounted on disc segment 28. In like manner, a group of four knives 44 are mounted on disc segment 24, with these staggered with respect to the knives on disc segment 26 but aligned with the knives on disc segment 28. A group of four knives 46 are detachably mounted on disc segment 22, with these staggered with respect to those knives on disc segment 24.

All of the knives 40, 42, 44 and 46 have a similar mounting on the cutter head body. Specifically, and considering one of the knives 40 (refer to FIG. 3), at the location of the knife, the disc segment is provided with a pocket 50. Seated within this pocket is a mounting base 54. The base is secured in place, as with screws 56, 58 extending from the base into the disc segment. An adjustment set screw 60 is provided, with its bottom end abutting the floor of pocket 50, which may be advanced or retracted to produce a slight adjustment in the position of the mounting base with respect to the pocket receiving it.

The mounting base along its top has a gullet 64 and a shelf 66. The shelf receives a counter knife element 68. Positioning the counter knife element, and securing it in place, are dowel pins such as dowel pin 70, and screw 72. Knife 40 is a double-edged knife, having a length only slightly in excess of the width of disc segment 28. Knife 40 is supported on the top of the counter knife. Knife 40 has a shallow key slot 80 extending along the bottom thereof (which is the front side of the knife with the knife moving to cut material), which fits over and snugly receives elongate key projection 82 at the top of the counter knife. Clamping the knife in place as so positioned is a knife clamp 86, which has a forward portion bearing against the back of the knife, and a rear portion **86*b* resting on a shoulder 88 of the mounting base 54. Securing the knife clamp in place is a fastener 90**.

As so positioned, an edge 92 of knife 40 is held in an exposed, operative, cutting position. Its opposite edge 94 is supported in a shielded, non-operative, non-cutting position. The exposed cutting edge of the knife on meeting wood material cuts into the material to cut a chip from this material, with this chip moving downwardly over the front side of the knife against the counter knife and into the gullet 64 of mounting base 54.

It should be obvious that with dulling of cutting edge 92, knife 40 may be removed simply by loosening fastener 90 and removing the clamp. The knife may then be repositioned to place its edge 94 in an operative, exposed, cutting position, and its now dulled edge 92 in the inoperative non-cutting position. Returning the knife clamp and securing it in place functions to clamp the knife in its new operative position.

The exposed operative cutting edges of the various knives mounted on the plural disc segments disclosed extend generally in an axial direction on the periphery or circumference of the cutter head. A group of multiple cutting edges are presented on each disc segment, and the cutting edges in this group are staggered with respect to the cutting edges in the group of knives supported on an immediately adjacent disc segment.

Working in concert with these double-edged knives, which produce the chips resulting in wood removal, are multiple knives supported on the end of cutting head which function to cut a smooth flat surface or finish surface in the side of the log which has had a slab removed from it in the form of chips.

Figure 2:
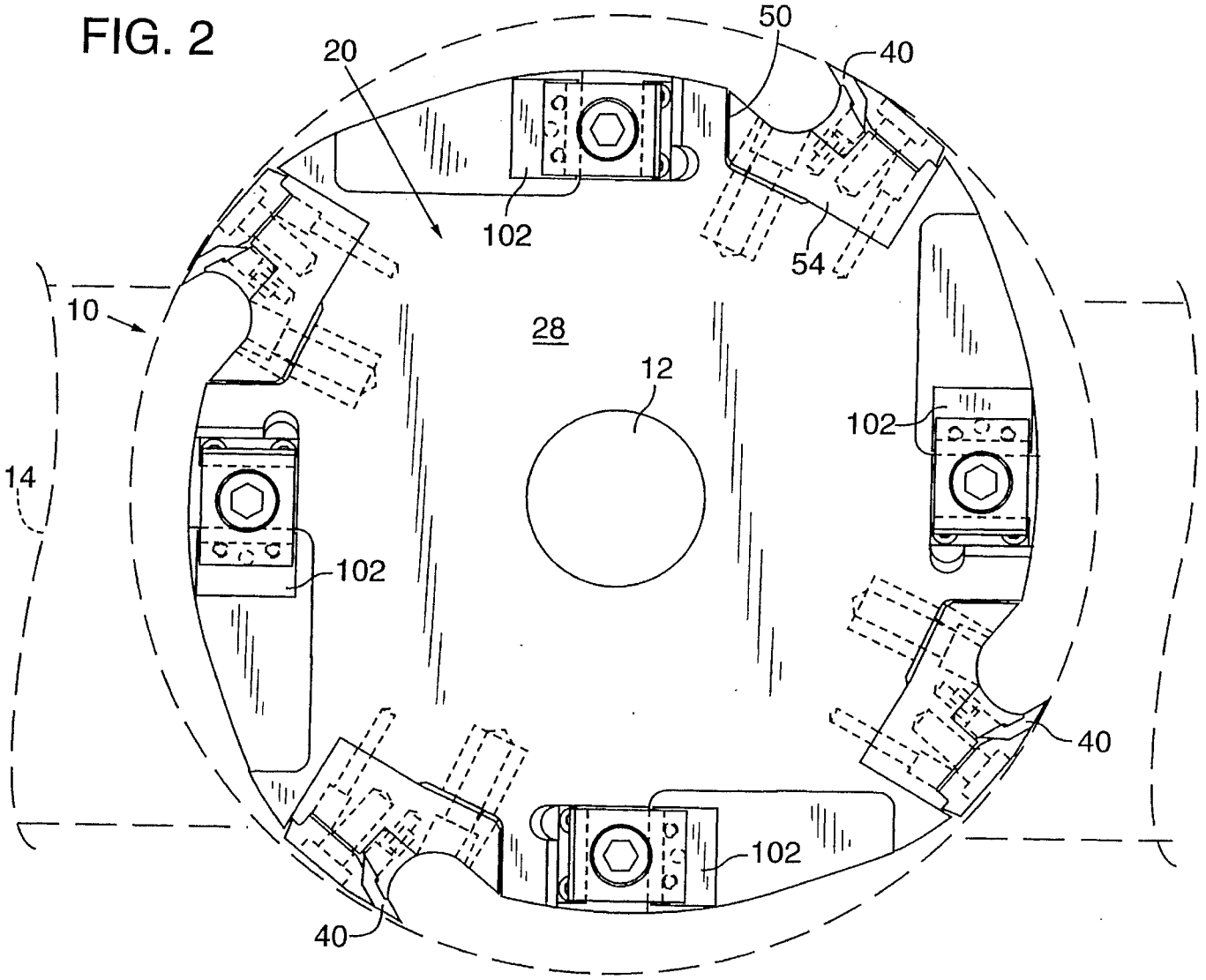
FIG. 2 is an end view of the cutter head shown in FIG. 1.
Figure 3:
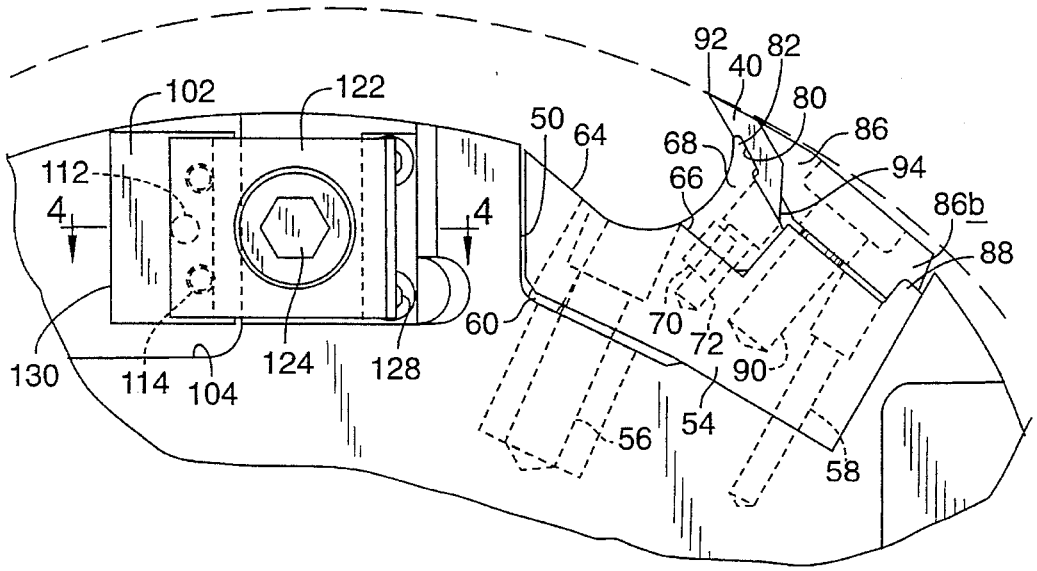
FIG. 3 is an enlarged view of portions of FIG. 2.
Figure 4:
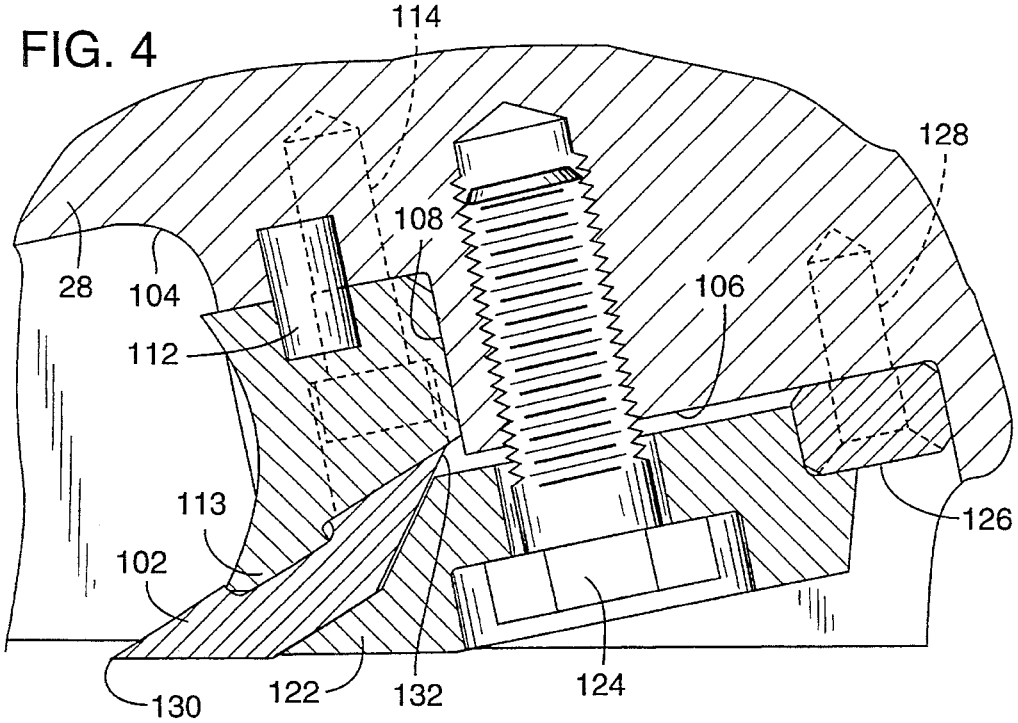
FIG. 4 is an enlarged, cross-sectional view, taken along the line 4—4 in FIG. 3.

In the particular cutting head herein disclosed, and referring to FIGS. 2, 3 and 4, four such knives, referred to herein as planar cutting knives, are located on the end of the cutting head. These are shown at 102. The mounting for the respective planar cutting knives are all similar, and thus only one will be described in detail.

Referring to the drawings, adjacent each planar cutting knife, and formed in disc segment 28, is a pocket 104 which receives chip material cut by the knife. Adjacent pocket 104, the disc segment is provided with a recess 106 and shelf 108.

Shelf 108 receives a counter knife element 110, which has a projecting elongate key 113 extending along the top thereof. A dowel pin 112 and set screws 114 position the counter knife element and secure it in place. Double-edged knife 102, which may resemble knife 40, seats with a key slot 116 extending along one side of the knife (the front side) fitting over key 113.

A clamp 122 clamps against the back side of the knife to secure it in place. The clamp is secured in place with a fastener 124. The rear of the clamp rests on an abutment piece 126 secured in place within recess 106 by fasteners 128.

It will be noted that knife 102 has one edge 130 positioned in an exposed, operative, cutting position, which typically in an ordinary installation is located outwardly from the side of disc segment 28 a distance of from 0.03 to 0.06 inch. Its opposite edge 132 is supported in a shielded, non-operative, non-cutting position. With dulling, it is a simple matter to loosen and remove clamp 122, with the knife then being repositionable to place its edge 132 in an operative cutting position and its edge 130 in its shielded position. The front side of the knife, as can be seen in FIG. 4, faces inwardly at the end of the cutter head body and the back side faces outwardly. The front side of the knife extends at an acute angle with respect to the plane of the end face of the cutter head body, and this angle is such that the front face more closely parallels the plane of the end face than a plane normal to the end face plane. In this way, the front side provides for the ready flow of material thereover on such material being cut by the knife. It will further be noted that key slot 116 substantially parallels the cutting edges on opposite margins of the knife. With the knife mounted in place, the key presented by a counter knife fits within the key slot of a knife and provides a firm mounting resisting shifting of the knife in a direction normal to the cutting edges. It should also be noted that the knife when repositioned to place a new edge in cutting position occupies a position where its front side still faces inwardly to provide a mounting wherein key 113 snugly resides within the key slot.

Describing a particular construction, logs advanced at a feed rate of 500 feet per minute have been easily processed with a cylindrical cutting head having an overall outer diameter of approximately 20 inches and rotated at approximately 1200 rpm. While a cutter head has been disclosed with four disc segments making up the body of the head, it should be obvious that this number could be increased or decreased in other installations depending upon the specifics involved.

While a specific embodiment of the invention has been disclosed, variations and modifications are possible without departing from the invention.

It is claimed and desired to secure by letters patent:

1. A substantially cylindrical chipping cutter head comprising:

multiple disc-shaped body sections axially aligned with each other and collectively forming a substantially cylindrical cutter head body which is rotatable about an axis extending axially of the cutter head body, said cutter head body having at one end thereof an end face that occupies a plane which is substantially normal to the axis of the cutter head body, multiple end-located detachably mounted knives mounted on said one end of said body and distributed about said axis, said knives having operative cutting edges movable in a plane disposed normal to said axis, and multiple circumferentially located knives mounted on the cutter head body with operative cutting edges extending generally in an axial direction on said cutter head, each of said end-located knives having a front side facing inwardly at the end of the cutter head body and a back side facing outwardly, and the front side of an end-located knife extending at an acute angle with respect to said plane of the end face, the angle being such that the front side more closely parallels the plane of the end face than a plane normal to the end face plane, thus to provide for the ready flow of material thereover when cut by the knife.

2. The chipping cutter head of claim 1, which includes a mounting for each end-located knife comprising a key slot extending along the front side of the knife substantially paralleling its operative cutting edge, and a counter knife detachably secured to the cutter head body, the counter knife having a projecting key fitting within the key slot of the knife.

3. The chipping cutter head of claim 2, wherein each of said end-located knives is a double-edged knife with opposite substantially parallel cutting edges, one of said edges being the operative cutting edge in the cutter head, the knife being repositionable on said body to place the other of said edges in a position being the operative cutting edge, the knife being repositionable with maintaining of the front side facing inwardly and with the projecting key of the counter knife fitting within the key slot of the knife.

4. A substantially cylindrical chipping cutter head comprising:

a substantially cylindrical cutter head body which is rotatable about an axis extending axially of the cutter head body, said cutter head body having at one end thereof an end face occupying a plane that is substantially perpendicular to the axis of the cutter head body, multiple end-located detachably mounted knives mounted on said one end of said body and distributed about said axis, said knives having operative cutting edges movable in a plane disposed normal to said axis, and multiple circumferentially located knives mounted on the cutter head body with operative cutting edges extending generally in an axial direction on said cutter head, and each of said end-located knives having a front side facing inwardly at the end of the cutter head body and a back side facing outwardly, and the front side of an end-located knife extending at an acute angle with respect to the plane of the end face, the angle being such that the front side more closely parallels the plane of the end face than a plane normal to the end face plane, thus to provide for the ready flow of material thereover when cut by the knife.

* * * * *